US006976293B2

(12) United States Patent
Traulle et al.

(10) Patent No.: US 6,976,293 B2
(45) Date of Patent: Dec. 20, 2005

(54) SLIDE FASTENER WITH BLOCKING OF THE SLIDER

(75) Inventors: Florian Traulle, Aix les Bains (FR); Marielle Deschamps, Annecy le Vieux (FR)

(73) Assignee: Salomon S.A., Metz-Tessy (FR)

( * ) Notice: Subject to any disclaimer, the term of this patent is extended or adjusted under 35 U.S.C. 154(b) by 41 days.

(21) Appl. No.: 10/649,650

(22) Filed: Aug. 28, 2003

(65) Prior Publication Data

US 2004/0074059 A1 Apr. 22, 2004

(30) Foreign Application Priority Data

Aug. 29, 2002 (FR) ..... 02 11015

(51) Int. Cl.[7] ..... A44B 19/36
(52) U.S. Cl. ..... 24/436; 24/435
(58) Field of Search ..... 24/436, 405; 2/96, 2/100, 128

(56) References Cited

U.S. PATENT DOCUMENTS 2,087,045 A * 7/1937 Goodman et al. ..... 24/390
2,190,608 A 2/1940 Poux ..... 24/205
2,341,331 A * 2/1944 Parkin ..... 24/436
2,381,359 A * 8/1945 Mikulas ..... 24/436
2,915,798 A * 12/1959 Hewitt, Jr. ..... 24/436
3,872,552 A 3/1975 Hofius ..... 24/205.11 F
5,918,310 A * 7/1999 Farahany ..... 2/228
6,112,383 A * 9/2000 Salam ..... 24/435

* cited by examiner

*Primary Examiner*—Robert J. Sandy
(74) *Attorney, Agent, or Firm*—Greenblum & Bernstein, P.L.C.

(57) ABSTRACT

A slide fastener, of the type having two strips provided with fastening devices, and having a slider that slides along the length of the edges of the strips to control the closing/locking and the opening/unlocking of the fastening devices of the two strips. The slide fastener has a blocking device affixed to one of the strips and that, when the two strips are interconnected by their fastening devices, extends across the path of the slider to block its movement in the opening/unlocking direction. The blocking device includes a feature whereby the retraction of the blocking device is automatically accomplished when the slider passes in the area of the blocking device in the closing/locking direction, and whereby the blocking device automatically returns to its blocking position after the passage of the slider.

25 Claims, 2 Drawing Sheets

SLIDE FASTENER WITH BLOCKING OF THE SLIDER

CROSS-REFERENCE TO RELATED APPLICATION

This application is based upon French Patent Application No. 02.11015, filed Aug. 29, 2002, the disclosure of which is hereby incorporated by reference thereto in its entirety and the priority of which is hereby claimed under 35 U.S.C. §119.

BACKGROUND OF THE INVENTION

1. Field of the Invention

The invention relates to a slide fastener.

It relates more particularly to a slide fastener of the type having two strips, each of which is provided with a fastening device along one of its edges, and having a slider that slides along the edges of the strips to control, during a movement of the slider in a locking direction, the locking of the fastening devices of the two strips and, during a movement of the slider in an unlocking direction, the unlocking of the fastening devices of the two strips.

2. Description of Background and Relevant Information

Fastening devices can take various forms. They can be two series of teeth, each arranged on a strip in an offset manner to be engaged one in the other in order to lock the two strips, thereby constituting a fastener of the "zipper" type. They can also be two complementary continuous sections of the male-female type whose engagement or disengagement is controlled by the slider. In certain slide fasteners, the fastening means can be made in the form of two spiral elements that are connected to each of the strips and that are nested one in the other. All of these types of slide fasteners are well known to those persons skilled in the art.

The slider acts on the fastening devices in one direction to bring them close together (i.e., the "locking direction," thus causing the cooperation of the fastening devices and their locking), and in the other direction to separate them (i.e., the "unlocking direction," thus causing the unlocking of the fastening devices of the two strips). The slider therefore slides along the length of the slide fastener while being guided by the fastening devices.

These types of slide fasteners are used in numerous applications, but specifically to achieve a resealable opening between two pieces of flexible material, for example, in garments. It is advantageous for the handling of the slide fastener to be as easy as possible, i.e., for the sliding of the slider along the length of the slide fastener to be done with a minimum of effort.

However, there is then the risk that the slider may become displaced along the length of the slide fastener in the unlocking direction under the sole effect of interfering forces sustained by the slide fastener. This is particularly true with respect to garments where slide fasteners are subject to alternative deformations of the pieces of fabric that they bring close together. This is all the more true when the slide fastener is arranged to be vertical in use with an upper locking position, as gravity then acts on the slider in the direction for unlocking the slide fastener.

Systems for locking the slider in a given position have already been proposed. Thus, there are slide fasteners in which the slider has a movable pull tab adapted to enable one to grip the slider, this pull tab being further provided with a blocking member that, in a position for blocking the pull tab, cooperates with the means for fastening the slide fastener in order to block the slider. For this blocking to be effective, however, it is imperative that the pull tab remain in its blocked position, which is not always guaranteed. Applications are also known in which a strip of fabric is provided which is fixed to one side of the slide fastener and which has anchoring means (for example, self-gripping strips of the Velcro® type, i.e., hook and loop fastening elements), such that it is possible to attach the strip of fabric across the longitudinal direction of the slide fastener. The strip of fabric, once positioned in this manner, thus prevents the slider from being displaced in an unlocking direction. Such a system nonetheless requires one to remember to position the strip of fabric after each closure of the slide fastener. In addition, it is sometimes difficult to unfasten the strip of fabric when one wants to manipulate the slider in the unlocking direction.

SUMMARY OF THE INVENTION

An object of the invention, therefore, is to propose a slide fastener that is provided with improved blocking mechanism that is both simple to construct and simple to use, and which ensures a reliable blocking of the slider in the position desired.

To this end, the invention encompasses a slide fastener having a blocking mechanism that is directly or indirectly affixed to one of the strips and which, when the two strips are interconnected by their fastening devices, assumes a blocking position across the path of the slider so as to interfere with movement of the slider in the unlocking direction. Further, according to the invention, the blocking mechanism includes a feature that provides for the automatic retraction of the blocking mechanism when the slider passes in the area of the blocking mechanism in the locking direction, and for the automatic return of the blocking mechanism to its blocking position after the passage of the slider.

BRIEF DESCRIPTION OF DRAWINGS

Other characteristics and advantages of the invention will become apparent from reading the following detailed description, with reference to the attached drawings, in which.

DETAILED DESCRIPTION OF THE INVENTION

Figure 1:
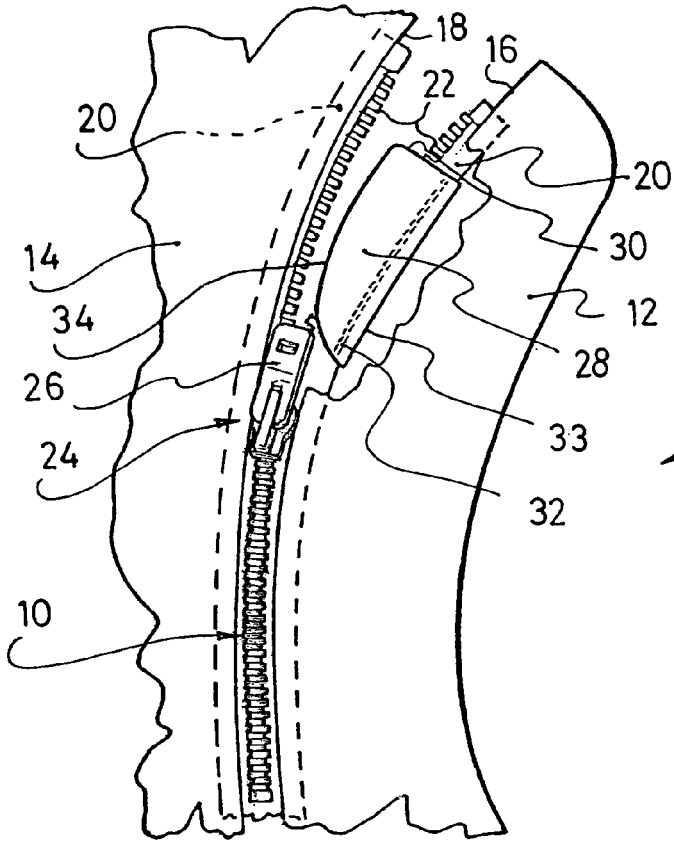
FIG. 1 is a schematic plan view of a slide fastener according to the invention, in which the slider is positioned beyond a blocked position.

A slide fastener 10 is shown in the drawing figures which, when it is locked, is adapted to ensure the joining of two pieces 12, 14 of material. These pieces of material can be pieces of flexible material, such as pieces of fabric, pieces of neoprene, etc. These two pieces can be part of the same panel of material; they can be part of distinct panels of the same material; or they can be part of distinct panels of distinct materials.

In the example shown, the slide fastener 10 is adapted to allow the joining of two corresponding edges 16, 18 of the two pieces 12, 14. These two edges 16, 18 are in this case substantially parallel and extend along a curved line, but they could also be straight.

The slide fastener 10 has two strips 20 that are each fixed to a respective one of the pieces 12, 14 in the area of the corresponding edge 16, 18. The strips 20 can be strips of fabric, for example, and they can be attached to the pieces 12, 14 by any means, for example, by stitching and/or by gluing. The strips are each provided with fastening devices 22 that are shown in the drawings as teeth, but which could have any other known form. As shown, the teeth could then form the track of a slide fastener commonly referred to as a "zipper." Likewise, these fastening devices can be metallic or plastic. As known, the slide fastener has a slider 24 provided with a pull tab 26, the slider being capable of sliding along the length of the slide fastener so as to cause, below it, the nesting and the locking of the fastening means 22 of the two strips, and, above it, the disengagement and the unlocking of these same fastening devices. The functioning mode of the slide fastener will not be described here in more detail as it is well known to those skilled in the art.

Figure 2:
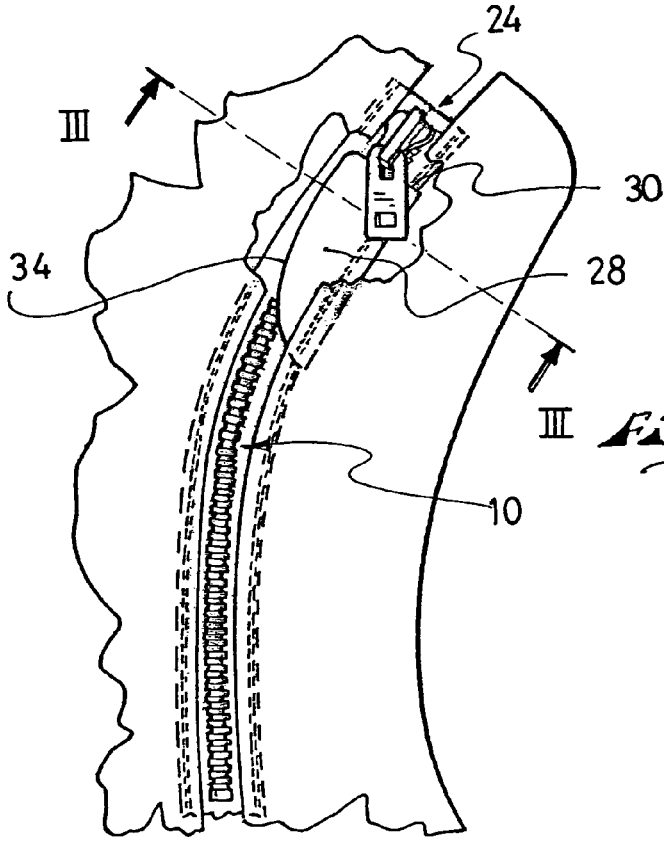
FIG. 2 is a view similar to that of FIG. 1 in which the slider is shown in the blocked position.

The particular orientation of the slide fastener 10 shown in FIGS. 1 and 2 is exemplary and is not limiting. For convenience of description, the slider 24 is described as moving upwardly in a closing/locking direction, such as from the position shown in FIG. 1 to the position shown in FIG. 2, and as moving downwardly in an opening/unlocking direction, such as from the position shown in FIG. 2 to the position shown in FIG. 1. However, depending upon the particular application to which the slide fastener of the invention is used, the slider 24 could be movable downwardly in a closing/locking direction. In addition, although the style of the slide fastener 10 shown in FIGS. 1 and 2 includes an open end in the opened position of FIG. 1, the slide fastener could include any combination of closed or open ends.

According to the invention, the slide fastener 10 has means for blocking the slider 24 in a predetermined position, in this case a position in which the slide fastener is locked, so as to avoid an accidental unlocking, or opening, of the slide fastener.

The slide fastener 10 has a blocking member that, in the example shown, has the form of a plate element 28 that extends in a plane substantially parallel to the plane of the strips 20 of the slide fastener, i.e., also the plane of the direction of engagement of the fastening means 22. The plane of the slide fastener 10 is a theoretical plane defined when the slide fastener is isolated, flat, before its assembly to the article in which it is integrated. According to the invention, this blocking member 28 has a blocking edge 30 that, at rest, extends transverse, i.e., substantially perpendicular as shown, to the longitudinal direction of the slide fastener, while being substantially parallel to the plane thereof. This blocking member 28 is directly or indirectly fixed to one of the strips 20 of the slide fastener 22. In the example shown, a lateral edge 33 of the blocking member 28, substantially parallel to the longitudinal direction of the slide fastener, is fixed by gluing or by stitching 32 to the strip 20, on the one hand, and to the edge of the corresponding flap/piece 12, on the other hand, the blocking member 28 being sandwiched between the piece 12 and the strip 20. Other manners of assembly are also possible according to the invention.

Figure 3:
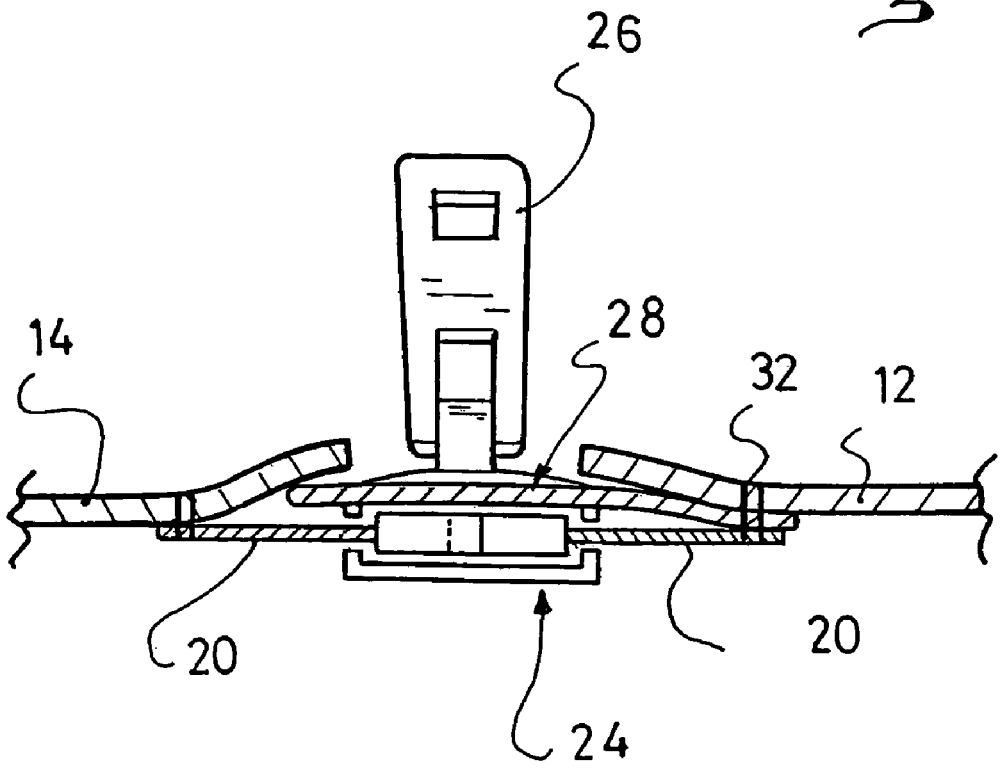
FIG. 3 is a cross-sectional view along the line III—III of FIG. 2.

As can be seen in FIG. 3, the blocking member 28, at rest, is substantially pressed against the slide fastener 10.

According to the invention, the blocking member 28 has a device to automatically retract and not to interfere with the passage of the slider 24 when the slider is moved in the closing/locking direction, i.e., from the position shown in FIG. 1 to the position shown in FIG. 2. In this case, this retracting device includes an edge 34 of the blocking member 28 which edge is inclined with respect to the longitudinal direction of the slide fastener, therefore with respect to the path of the slider 24. In the example shown, this edge 34 is shown to be curved inwardly and eventually meets the blocking edge 30. The joining of the two edges 34 and 30 edges forms a rounded right angle. The retracting edge 34 also extends across the path of the slider 24, but its inclination is such that, instead of causing a blocking of the slider, it forms a ramp such that the cooperation of the slider 24 with the blocking edge 30 tends to lift the blocking member 28 until it retracts from the path of the slider 24.

In the illustrated example, the retracting edge 34 follows approximately a quarter of an ellipse whose major axis would be generally parallel to the longitudinal direction of the slide fastener, in this case almost merged with the lateral edge 33 of the blocking member 28 by which the blocking member is fixed to the strip 20.

In the example shown, the blocking member 28 is made of plastic and has a thickness on the order of 1 millimeter (mm), or about 1 mm. Furthermore, it can be seen that the blocking member is fixed only to flexible materials (in this case, a neoprene panel and a fabric strip) along a stitched seam 32. As a result, the blocking member 28 can bend easily, either by deformation of the blocking member itself or by "pivoting" about the stitching line 32. Thus, when the slider 24 comes into contact with the retracting edge 34, while being moved in the closing direction, the slider 24 exerts a force on the blocking member 28 that automatically causes the lifting of the blocking member towards a retracted position. Indeed, the edge 34 of the blocking member 28 tends to lift with respect to the initial plane of the strips 20 of the slide fastener 10, until the slider 24 can pass under the blocking member 28 and pursue its course in the closing direction. According to the invention, the slider 24 can be provided to have an end (the end that engages the edge 34 of the blocking member 28) which has a shape to promote the automatic retracting movement of the blocking member. Likewise, the edge 34 can be shaped in the direction of its thickness so as to facilitate further the retraction of the blocking member 28 during interaction with the slider 24. However, tests have shown that the system functions perfectly with a conventional slider and with a straight edged blocking member. Depending on the type of the material of the blocking member, the retracting edge 34 (but also the blocking edge 30) can be provided to be reinforced to limit the problems of wear due to friction with the slider 24.

When the slider 24 extends past the blocking edge 30 of the blocking member 28, the blocking member automatically returns to press itself into the blocking position against the strips 20 of the slide fastener 10, simply due to the elasticity of the system.

If the slider 24, due to interfering forces exerted on the slide fastener, were to tend to be forced in the opening direction, it would abut against the blocking edge 30 of the blocking member 28, which extends substantially perpendicular to the path of the slider 24 and, thereby, would block the slider. This type of blocking could not resist substantial forces, but once again, tests have shown that this blocking prevents any ill-timed opening of the slide fastener in normal use.

In order to allow the unlocking/opening of the slide fastener 10, the user only has to lift the blocking member 28 slightly to allow for the passage of the slider 24 under the blocking member 28 and thus allow the slider 24 to be moved in the opening direction.

Thus, by arranging a blocking member 28 according to the invention in the vicinity of the closing end of the slide fastener, a blocking thereof in the closed position is guaranteed.

It is to be understood from the preceding description that the blocking member 28 must therefore have a certain flexibility, either in itself or due to its method of assembly to the slide fastener and/or to the article on which the slide fastener is mounted. The blocking member could thus be constituted of a more rigid material but connected to the slide fastener by a connection forming an elastic articulation.

On the contrary, the blocking member 28 must have a certain rigidity to oppose the force of the slider 24 when the slider tends to return in an opening direction. The system formed by the blocking member and by its assembly to the article and/or to the slide fastener must therefore be semi-flexible. It is noted that the form of the blocking member selected in the example shown, albeit not required, allows for reconciling these two contradictory requirements while having a particularly simple design.

The invention will be particularly useful in neoprene suits for aquatic sports. Indeed, in suits of this type, the slide fastener is generally located on the back of the garment, i.e., in a position that is difficult for the user to access. The slide fasteners used in these applications preferably have large plastic teeth that resist both the corrosive effect of sea water and the risks of blocking due to sand. Furthermore, these slide fasteners must have a slider that slides easily to prevent making its manipulation almost impossible since it is located on the back. All of this subjects these slide fasteners to ill-timed openings, which shows the interest and the advantage of an automatic blocking system according to the invention. Indeed, the blocking of the slider in the closed position is automatically obtained in all cases without any particular intervention of the user.

What is claimed is:

1. A slide fastener comprising:

a first strip of material and a second strip of material;

a first fastening device extending along and affixed to a longitudinally extending edge of said first strip of material and a second fastening device extending along and affixed to a longitudinally extending edge of said second strip of material;

a slider mounted for longitudinal sliding in a path along said first and second edges of said first and second strips of material to control closing and opening of the first and second fastening devices by, respectively, causing a locking of said first fastening device to said second fastening device in a closing direction and an unlocking of said first fastening device from said second fastening device in an opening direction;

a blocking member directly or indirectly affixed to one of said first and second strips whereby, when said first and second strips are interconnected by said first and second fastening devices, said blocking member extends in a blocking position across said path of said slider to interfere with movement of said slider in said opening direction;

said blocking member further comprising a retracting device to cause automatic retraction of said blocking member as said slider moves and engages said blocking member in said closing direction, whereby said blocking member comprises a construction to cause automatic return of said blocking member to said blocking position after said slider moves beyond said blocking member in said closing direction.

2. A slide fastener according to claim 1, wherein:

said retracting device comprises a ramp inclined with respect to said path of said slider in said closing direction, whereby said slider is engagable with said inclined ramp to move said blocking member toward a retracted position, and whereby said blocking member returns to said blocking position after said slider moves beyond said blocking member in said closing direction.

3. A slide fastener according to claim 1, wherein:

said blocking member has a form of a plate, whereby, in said blocking position, said plate extends in a plane substantially parallel to a plane of said first and second strips of material;

said plate element comprises a blocking edge, said blocking edge extending substantially perpendicular to said path of said slider.

4. A slide fastener according to claim 3, wherein:

said blocking member comprises an edge that is inclined with respect to said path of said slider.

5. A slide fastener according to claim 1, wherein:

said blocking member is directly or indirectly connected to one of said first and second strips of material along a length of a lateral edge, substantially parallel to said path of said slider.

6. A slide fastener according to claim 1, wherein:

said blocking member is assembled to a flexible panel with said one of said first and second strips by means of a common stitching.

7. A slide fastener according to claim 1, wherein:

said blocking member is made from semi-flexible material.

8. A slide fastener according to claim 1, wherein:

said fastening devices are made of a plastic material.

9. A slide fastener comprising:

a first strip of material and a second strip of material;

a first fastening device extending along and affixed to a longitudinally extending edge of said first strip of material and a second fastening device extending along and affixed to a longitudinally extending edge of said second strip of material;

a slider mounted for longitudinal sliding in a path along said first and second edges of said first and second strips of material to control closing and opening of the first and second fastening devices by, respectively, causing a locking of said first fastening device to said second fastening device in a closing direction and an unlocking of said first fastening device from said second fastening device in an opening direction;

a blocking member directly or indirectly affixed to one of said first and second strips whereby, when said first and second strips are interconnected by said first and second fastening devices, said blocking member extends in a blocking position across said path of said slider to interfere with movement of said slider in said opening direction;

said blocking member having a form of a plate, whereby, in said blocking position, said plate extends in a plane substantially parallel to a plane of said first and second strips of material;

said plate comprising a blocking edge, said blocking edge extending substantially perpendicular to said path of said slider;

said blocking member comprising an edge that is inclined with respect to said path of said slider to cause automatic retraction of said blocking member as said slider moves and engages said blocking member in said closing direction.

10. A slide fastener according to claim 9, wherein:

said blocking member returns to said blocking position after said slider moves beyond said blocking member in said closing direction.

11. A slide fastener according to claim 9, wherein:

said blocking member is directly or indirectly connected to one of said first and second strips of material along a length of a lateral edge, substantially parallel to said path of said slider.

12. A slide fastener according to claim 9, wherein:

said blocking member is assembled to a flexible panel with said one of said first and second strips by means of stitching.

13. A slide fastener according to claim 9, wherein:

said blocking member is made from semi-flexible material.

14. A slide fastener according to claim 9, wherein:

said blocking member is made of plastic.

15. A slide fastener comprising:

a first strip of material and a second strip of material;

a first fastening device extending along and affixed to a longitudinally extending edge of said first strip of material and a second fastening device extending along and affixed to a longitudinally extending edge of said second strip of material;

a slider mounted for longitudinal sliding in a path along said first and second edges of said first and second strips of material to control closing and opening of the first and second fastening devices by, respectively, causing a locking of said first fastening device to said second fastening devices in a closing direction and an unlocking of said first fastening device from said second fastening device in an opening direction;

a blocking member constructed so, when said first and second strips are interconnected by said first and second fastening devices, said blocking member extends in a blocking position across said path of said slider to interfere with movement of said slider in said opening direction;

said blocking member further comprising a retracting device to cause automatic retraction of said blocking member as said slider moves and engages said blocking member in said closing direction.

16. A slide fastener according to claim 15, wherein:

said retracting device comprises a ramp inclined with respect to said path of said slider in said closing direction, whereby said slider is engagable with said inclined ramp to move said blocking member toward a retracted position.

17. A slide fastener according to claim 16, wherein:

said blocking member returns to said blocking position after said slider moves beyond said blocking member in said closing direction.

18. A slide fastener according to claim 15, wherein:

said blocking member has a form of a plate, whereby, in said blocking position, said plate extends in a plane substantially parallel to a plane of said first and second strips of material;

said plate comprises a blocking edge, said blocking edge extending substantially perpendicular to said path of said slider, and wherein said plate comprises an edge that is inclined with respect to said path of said slider.

19. A slide fastener according to claim 15, wherein:

said blocking member is made from semi-flexible material.

20. A slide fastener assembly comprising:

a first lengthwise extending fastening device and a second lengthwise extending fastening device;

a slider mounted to slide in a lengthwise path along said first and second fastening devices in a closing direction to engage said first and second fastening devices and in an opening direction to disengage said first and second fastening devices, said slider thereby being mounted to slide between closed and open positions of the slide fastener;

a blocking member mounted to extend across said first and second fastening devices in the closed position of the slide fastener to present a blocking portion of said blocking member for engagement with a portion of said slider;

in said closed position of the slide fastener, said slider extending lengthwise in said closing direction past said blocking portion of said blocking member to interfere with movement of said slider in the opening direction.

21. A slide fastener assembly according to claim 20, further comprising:

a first piece of material to which the first fastening device is connected, and a second piece of material to which the second fastening device is connected, said first and second pieces of material comprising distinct panels of a garment or a single panel of a garment.

22. A slide fastener assembly according to claim 21, wherein:

said blocking member is affixed to only one of the first and second pieces of material and extends across said first and second fastening devices toward the other of the first and second pieces of material.

23. A slide fastener assembly according to claim 22, wherein:

said blocking member is made of a flexible material to enable lifting of the blocking member to allow the slider to pass beneath the blocking member.

24. A slide fastener assembly according to claim 20, wherein:

said first and second fastening devices comprise first and second series of teeth, the slide fastener thereby constituting a zipper.

25. A slide fastener assembly according to claim 24, further comprising:

a pull tab movably connected to the slider to facilitate movement of the slider.

* * * * *